US011396737B2

(12) United States Patent
Wang et al.

(10) Patent No.: US 11,396,737 B2
(45) Date of Patent: Jul. 26, 2022

(54) REGENERATION CONTROL HYDRAULIC SYSTEM

(71) Applicant: JIANGSU HENGLI HYDRAULIC TECHNOLOGY CO., LTD., Changzhou (CN)

(72) Inventors: Liping Wang, Changzhou (CN); Guohe Huang, Changzhou (CN); Jing Jia, Changzhou (CN); Liang Ha, Changzhou (CN); Hongguang Liu, Changzhou (CN); Junxiang Han, Changzhou (CN); Li Zhai, Changzhou (CN)

(73) Assignee: JIANGSU HENGLI HYDRAULIC TECHNOLOGY CO., LTD., Changzhou (CN)

( * ) Notice: Subject to any disclaimer, the term of this patent is extended or adjusted under 35 U.S.C. 154(b) by 0 days.

(21) Appl. No.: 17/414,054

(22) PCT Filed: Sep. 22, 2020

(86) PCT No.: PCT/CN2020/116877

§ 371 (c)(1),
(2) Date: Jun. 15, 2021

(87) PCT Pub. No.: WO2021/057727

PCT Pub. Date: Apr. 1, 2021

(65) Prior Publication Data

US 2022/0034070 A1 Feb. 3, 2022

(30) Foreign Application Priority Data

Sep. 26, 2019 (CN) ..... 201910916790.0
Sep. 26, 2019 (CN) ..... 201921620678.4

(51) Int. Cl.
*E02F 9/22* (2006.01)

(52) U.S. Cl.
CPC ..... *E02F 9/2267* (2013.01); *E02F 9/2246* (2013.01); *E02F 9/2292* (2013.01)

(58) Field of Classification Search
CPC ..... F15B 11/024; F15B 2211/3133; F15B 2011/0243; F15B 2011/0246; F15B 13/0403; F15B 2211/3058; E02F 9/2292
See application file for complete search history.

(56) References Cited

U.S. PATENT DOCUMENTS 10,844,886 B2 * 11/2020 Kondo ..... F15B 21/14
2013/0167522 A1 * 7/2013 Oguma ..... F15B 11/044 60/462
2016/0333903 A1 * 11/2016 Peterson ..... F15B 21/14

FOREIGN PATENT DOCUMENTS

CN 201679029 U 12/2010
CN 103608526 A 2/2014
(Continued)

OTHER PUBLICATIONS

International Search Report and Written Opinion dated Jan. 4, 2021 for Application No. PCT/CN2020/116877, 11 pages.
(Continued)

*Primary Examiner* — Abiy Teka
(74) *Attorney, Agent, or Firm* — Frost Brown Todd LLC

(57) ABSTRACT

A regeneration control hydraulic system for an excavator, including at least one hydraulic pump, an actuator, a regeneration oil path, and a regeneration cut-off oil path. The regeneration oil path is configured to send a return oil as a regeneration oil to a cavity having a negative pressure of the actuator. The regeneration oil path is provided with a regeneration valve and a first control valve. The first control valve is configured to control the regeneration oil to enter the cavity having the negative pressure of the actuator when a working device of the excavator retracts inwards, or to control the oil to be discharged from the actuator to the
(Continued)

regeneration cut-off oil path when the working device swings outwards. The regeneration cut-off oil path is configured to send the regeneration oil passing through the regeneration valve or the oil discharged from the actuator to other destinations.

9 Claims, 4 Drawing Sheets

(56) References Cited

FOREIGN PATENT DOCUMENTS

| | | | |
|---|---|---|---|
| CN | 208363156 | U | 1/2019 |
| CN | 209414291 | U | 9/2019 |
| CN | 110541857 | A | 12/2019 |
| CN | 210829928 | U | 6/2020 |
| EP | 1571352 | A1 | 9/2005 |
| JP | 2010-230061 | A | 10/2010 |
| JP | 2018-105334 | A | 7/2018 |

OTHER PUBLICATIONS

Japanese Office Action dated May 10, 2022 for Application No. 2021-529428, 10 pages.

* cited by examiner

REGENERATION CONTROL HYDRAULIC SYSTEM

CROSS-REFERENCE TO RELATED APPLICATIONS

The present application is a U.S. National Phase application under 35 USC § 371 of the International Patent Application No. PCT/CN2020/116877, filed on Sep. 22, 2020, which claims the benefit of prior Chinese Applications No. 201910916790.0 and No. 201921620678.4, filed with the China National Intellectual Property Administration on Sep. 26, 2019. The entire contents of the before-mentioned patent applications are incorporated by reference as part of the disclosure of this U.S. application.

FIELD

Embodiments of the present disclosure relate to a field of work machine hydraulic systems, and more particularly to a regeneration control hydraulic system.

BACKGROUND

In the current engineering machinery, the use of an excavator has been greatly promoted and applied. The fuel consumption, work efficiency and ease of operation of the excavator are the main focuses of various main engine manufacturing companies, research and development institutions, and customers. A working device of the excavator includes main parts such as a movable arm, a bucket rod, a bucket and a working-device hydraulic pipeline including a movable-arm cylinder, a bucket-rod cylinder, and a bucket cylinder. The bucket rod is an important part of the working device of the excavator. The reasonable arrangement of the hydraulic system of the bucket rod has a great significance to the working performance of the excavator.

SUMMARY

A regeneration control hydraulic system for an excavator according to embodiments of the present disclosure includes: at least one hydraulic pump configured to spray a working oil; an actuator configured to work by a supply of the working oil from the at least one hydraulic pump; a regeneration oil path configured to send a return oil as a regeneration oil to a cavity having a negative pressure of the actuator, wherein the return oil is the working oil discharged from the actuator, the regeneration oil path is provided with a regeneration valve and a first control valve, and the first control valve is configured to control the regeneration oil to enter the cavity having the negative pressure of the actuator when a working device of the excavator retracts inwards; and a regeneration cut-off oil path, the first control valve being further configured to control the oil to be discharged from the actuator to the regeneration cut-off oil path when the working device of the excavator swings outwards, the regeneration cut-off oil path being configured to send the regeneration oil passing through the regeneration valve or the oil discharged from the actuator to other destinations, and the regeneration cut-off oil path being provided with a regeneration cut-off valve.

DETAILED DESCRIPTION

Figure 1:
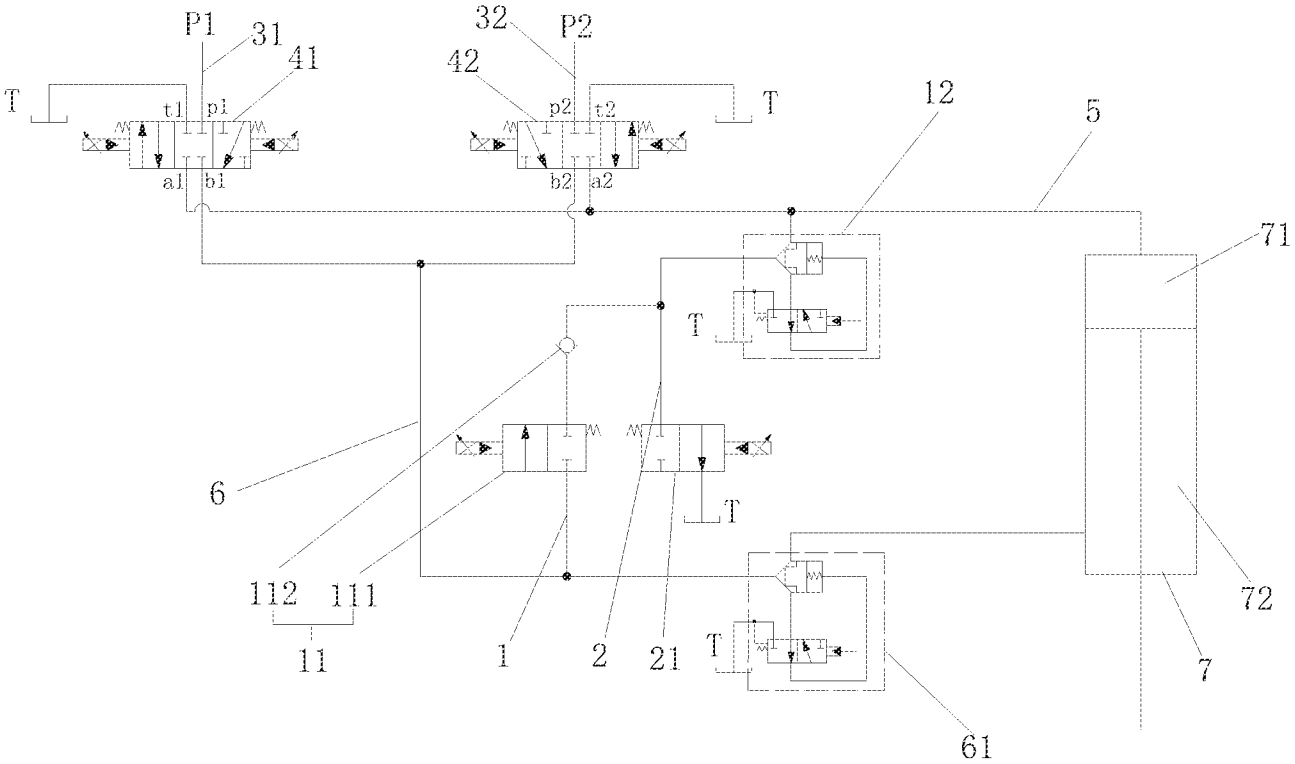
FIG. 1 is a schematic view of a regeneration control hydraulic system of the present disclosure.

References will be made in detail to embodiments of the present disclosure. The embodiments described herein with reference to drawings are illustrative, and configured to generally understand the present disclosure. The embodiments shall not be construed to limit the present disclosure. In the specification, it should be understood that terms such as "central", "longitudinal", "lateral", "length", "width", "thickness", "up", "down", "front", "rear", "left", "right", "vertical", "horizontal", "top", "bottom", "inner", "outer", "clockwise", "counterclockwise", "axial", "radial", "circumferential", etc. should be construed to refer to orientations or positions as illustrated in the drawings. These terms are merely for convenience of descriptions of the present disclosure and also for simplifying the descriptions, but do not indicate or imply that the device or element referred to should be constructed or operated in a particular orientation, so they should not be constructed as a limit to the present disclosure.

The present disclosure is made on a basis of the inventor's discovery and recognition of the following facts and problems.

In the related art, to improve the operating efficiency of the bucket rod, generally two hydraulic pumps are combined to realize the action of the bucket rod. The two hydraulic pumps have a bucket-rod valve correspondingly, and a regeneration oil path is arranged in a valve core of the bucket-rod valve, such that the regeneration of a small cavity to a large cavity of bucket rod can be realized by the regeneration oil path. When the bucket rod retracts inwards to be perpendicular to the ground, an excavation action needs to be carried out. The regeneration is cut off by a plug-in regeneration cut-off valve or a valve integrated to the valve core, so as to increase an excavation force. However, when the plug-in regeneration cut-off valve is used, the regeneration cut-off cannot be adjusted. However, when the regeneration and regeneration cut-off one-way valves are integrated to the valve core, the structure is complicated. Moreover, since the regeneration and the regeneration cut-off are integrated to the same valve core, the regeneration and the regeneration cut-off may have a control blind spot, and the responsiveness will be affected.

For this, embodiments of the present disclosure provide a regeneration control hydraulic system for an excavator, the regeneration control hydraulic system solves the technical problems of the regeneration control hydraulic system in the related art that the control structure of the regeneration and the regeneration cut-off is complicated, and has low adjustability and slow responsiveness.

The regeneration control hydraulic system for the excavator according to embodiments of the present disclosure includes: at least one hydraulic pump configured to spray a working oil, an actuator configured to work by a supply of the working oil from the at least one hydraulic pump; a regeneration oil path configured to send a return oil as a regeneration oil to a cavity having a negative pressure of the actuator, wherein the return oil is the working oil discharged from the actuator, the regeneration oil path is provided with a regeneration valve and a first control valve, and the first control valve is configured to control the regeneration oil to enter the cavity having the negative pressure of the actuator when a working device of the excavator retracts inwards; and a regeneration cut-off oil path, the first control valve being further configured to control the oil to be discharged from the actuator to the regeneration cut-off oil path when the working device of the excavator swings outwards, the regeneration cut-off oil path being configured to send the regeneration oil passing through the regeneration valve or the oil discharged from the actuator to other destinations, and the regeneration cut-off oil path being provided with a regeneration cut-off valve.

In the regeneration control hydraulic system according to the embodiments of the present disclosure, the regeneration oil path and the regeneration cut-off oil path are arranged, the regeneration oil path is provided with the regeneration valve, the regeneration cut-off oil path is provided with the regeneration cut-off valve, and the regeneration oil discharged from the actuator flows into the cavity having the negative pressure of the actuator through the regeneration oil path, such that the regeneration utilization is realized. The regeneration valve controls the working condition of the regeneration oil path. When the regeneration oil is not needed, the regeneration oil may flow to other destinations through the regeneration cut-off oil path. In addition, when the working device rises, the hydraulic oil discharged from the actuator may also flow to other destinations through the first control valve and the regeneration cut-off oil path. Compared with the related art, the regeneration valve and the regeneration cut-off valve do not need to be integrated to a pumping control valve of the hydraulic pump, such that the regeneration and regeneration cut-off control is simplified, and the responsiveness is good.

In some embodiments, the first control valve is a logic valve.

In the regeneration control hydraulic system according to the embodiments of the present disclosure, the first control valve is configured as the logic valve. Thus, on one hand, the logic valve and the regeneration cut-off valve may cooperate to cut-off the regeneration oil path. When the pressure in the cavity to which the regeneration oil flows reaches a certain value, the regeneration cut-off valve may be controlled to unblock the regeneration cut-off oil path, and thus the regeneration oil may flow to other destinations through the regeneration cut-off valve. On the other hand, when the working device swings outwards, the hydraulic oil discharged from the actuator may be transported to other destinations through the logic valve and the regeneration cut-off oil path, thereby increasing the area of the oil path, and reducing the pressure loss of the oil return of the outward swing. In this process, the opening pressure and the control relationship of the logic valve may be further set, such that the control without air suction of the outward swing of the working device can be realized, and thus the maneuverability and reliability of the action of the working device can be improved.

In some embodiments, the hydraulic pump comprises a first hydraulic pump and a second hydraulic pump, a pump outlet of the first hydraulic pump is provided with a second control valve, a pump outlet of the second hydraulic pump is provided with a third control valve, the actuator has a first cavity and a second cavity, and the first hydraulic pump under the control of the second control valve and the second hydraulic pump under the control of the third control valve are configured to be combined to supply the oil to the first cavity and the second cavity of the actuator, respectively. The working device responds quickly through the combination to supply the oil.

In some embodiments, the first cavity is in communication with a first working oil path, the second cavity is in communication with a second working oil path, the first hydraulic pump is configured to be in communication with the first working oil path and the second working oil path under the control of the second control valve, and the second hydraulic pump is configured to be in communication with the first working oil path and the second working oil path under the control of the third control valve.

In some embodiments, the first hydraulic pump is respectively in communication with the first working oil path and the second working oil path under the control of the second control valve, the second control valve includes a pressure oil port in communication with the pump outlet of the first hydraulic pump, an oil return port in communication with an oil return tank, and two working oil ports in communication with the first working oil path and the second working oil path, respectively.

In some embodiments, the second hydraulic pump is respectively in communication with the first working oil path and the second working oil path under the control of the third control valve, the third control valve includes a pressure oil port in communication with the pump outlet of the second hydraulic pump, an oil return port in communication with an oil return tank, and two working oil ports in communication with the first working oil path and the second working oil path, respectively.

In some embodiments, the second control valve and the third control valve both have a neutral position, a first working position and a second working position. When the second control valve and the third control valve are both in the first working position, the first hydraulic pump and the second hydraulic pump are combined to supply the oil to the first cavity of the actuator, the working oil discharged from the second cavity is regenerated to the first cavity via the regeneration oil path or is transported to the other destinations via the regeneration cut-off oil path. When the second control valve and the third control valve are both in the second working position, the first hydraulic pump and the second hydraulic pump are combined to supply the oil to the second cavity, the hydraulic oil discharged from the first cavity is transported to the other destinations via the first control valve and the second control valve and/or the regeneration cut-off oil path.

In the regeneration control hydraulic system according to the embodiments of the present disclosure, the control valve and the two working oil paths are arranged, the two hydraulic pumps can be combined to supply the oil to the two cavities, and the hydraulic oil discharged from the actuator can directly return to the oil return tank through the control valve, such that the oil return without the back pressure can be realized, and thus the oil consumption and the pressure loss can be reduced.

In some embodiments, both ends of the regeneration oil path are in communication with the first working oil path and the second working oil path, respectively.

In some embodiments, the second working oil path is further provided with a fourth control valve, and the fourth control valve is configured to control the working oil pumped by the first hydraulic pump and the second hydraulic pump to enter the second cavity or to control the oil to be discharged from the second cavity to the regeneration oil path.

In some embodiments, the fourth control valve is a holding valve.

Based on the above technical solutions, the present disclosure can achieve the following technical effects.

1. In the regeneration control hydraulic system of the present disclosure, the regeneration oil path and the regeneration cut-off oil path are arranged, the regeneration oil path is provided with the regeneration valve, the regeneration cut-off oil path is provided with the regeneration cut-off valve, and the regeneration oil discharged from the actuator flows into the cavity having the negative pressure of the actuator through the regeneration oil path, such that the regeneration utilization is realized. The regeneration valve controls the working condition of the regeneration oil path. When the regeneration oil is not needed, the regeneration oil may flow to other destinations through the regeneration cut-off oil path. In addition, when the working device swings outwards, the hydraulic oil discharged from the actuator may also flow to other destinations through the first control valve and the regeneration cut-off oil path. Compared with the related art, the regeneration valve and the regeneration cut-off valve are separately arranged to control the corresponding oil paths, and do not need to be integrated to the pumping control valve of the hydraulic pump, such that the regeneration and regeneration cut-off control is simplified, the pressure is decreased, and the responsiveness is good.

2. In the regeneration control hydraulic system of the present disclosure, the first control valve is configured as the logic valve. When the regeneration oil is recycled through the regeneration oil path, the valve core of the logic valve slides and opens under the action of the regeneration oil, so that the regeneration oil can flow to the first working oil path, and then regenerate to the first cavity. When the oil is discharged from the first cavity, the logic valve and regeneration cut-off valve may be controlled to open, so that the oil discharged from the first cavity can flow to other destinations through the logic valve and the regeneration cut-off oil path. Specifically, in the earlier stage of the working device retracting inwards, the regeneration valve is opened, the regeneration cut-off valve is closed, the oil discharged from the second cavity flows to the logic valve through the regeneration valve, the valve core of the logic valve is pushed to slide and open, and the oil discharged from the second cavity flows to the first working oil path to be combined with the pressure oil pumped by the two hydraulic pumps, so as to be supplied to the first cavity, thus achieving the regeneration combination and accelerating the inward retraction. In the later stage of the working device retracting inwards, that is, when the working device retracts inwards to be perpendicular to the ground, the regeneration valve is opened and the regeneration cut-off valve is also opened. The oil discharged from the second cavity passes through the regeneration valve and then is transported to other destinations through the regeneration cut-off oil path, so as to achieve the combination cut-off and improve the excavation force. In this stage, when the pressure of the first cavity reaches a certain value, the regeneration cut-off valve may be controlled to unblock the regeneration cut-off oil path, and the regeneration oil flows to other destinations through the regeneration cut-off valve, thereby improving the responsiveness of regeneration and the accuracy of control. In the stage of the working device swinging outwards, the two hydraulic pumps are combined to supply the oil to the second cavity, the oil discharged from the first cavity may be transported to other destinations through the logic valve and the regeneration cut-off oil path, which increases the area of the oil path and reduces the pressure loss of the oil return of the outward swing. In this stage, the opening pressure and the control relationship of the logic valve can be further set, such that the control without the air suction of the outward swing of the working device can be realized, and thus the maneuverability and reliability of the action of the working device can be improved. In addition, the regeneration oil path and the regeneration cut-off oil path are connected in parallel, and the regeneration cut-off valve in the regeneration cut-off oil path may be configured as a valve that can be adjusted to have any opening. In this way, during the process of the regeneration combination, by controlling the opening of the regeneration cut-off valve to return a part of the regeneration oil through the regeneration cut-off oil path, the oil flux of the regeneration oil regenerated to the first cavity can be controlled. The above adjustment process can control the oil flux of the regeneration oil regenerated to the first cavity only by adjusting the oil flux of the regeneration cut-off oil path, and the adjustment process is simple and controllable.

3. In the regeneration control hydraulic system of the present disclosure, the fourth control valve is configured as the holding valve. When the second control valve and the third control valve are in the neutral position, the slide valve can be prevented from leaking, and the working device can be prevented from falling naturally, thus holding the working device in place.

4. In the regeneration control hydraulic system of the present disclosure, the pumping oil paths of the two hydraulic pumps and the structures of the two control valves are reasonably arranged, such that the two hydraulic pumps can be combined to supply the oil to the two cavities, and the hydraulic oil discharged from the first cavity can be directly returned to the oil return tank through the control valve, so as to realize the oil return without the back pressure and to reduce the oil consumption and the pressure loss.

As illustrated in FIGS. 1-4, embodiments of the present disclosure provides a regeneration control hydraulic system, which is configured to drive a bucket rod of an excavator to work, and includes at least one hydraulic pump and an actuator 7, the at least one hydraulic pump discharges a working oil, and the actuator works through a supply of the working oil from the at least one hydraulic pump.

The actuator 7 may be a hydraulic cylinder, and has a first cavity 71 and a second cavity 72. The at least one hydraulic pump supplies oil to the first cavity 71 or the second cavity 71, and drives the actuator 7 to work. Specifically, the first cavity 71 of the actuator 7 is in communication with a first working oil path 5, and the working oil pumped by the at least one hydraulic pump enters the first cavity 71 of the actuator 7 via the first working oil path 5; the second cavity 71 of the actuator 7 is in communication with a second working oil path 6, and the working oil pumped by the at least one hydraulic pump enters the second cavity 71 of the actuator 7 via the second working oil path 6. In some embodiments of the present disclosure, the second working oil path 6 is further provided with a fourth control valve 61, and the fourth control valve 61 is configured to control the working oil pumped by two hydraulic pumps to enter the second cavity 71 or discharge the oil from the second cavity 71 to a regeneration oil path 1. In some embodiments of the present disclosure, the fourth control valve 61 is a holding valve.

In the embodiment, two hydraulic pumps are provided, namely a first hydraulic pump P1 and a second hydraulic pump P2. The first hydraulic pump P1 supplies the oil to the first cavity 71 and the second cavity 71 under the control of a second control valve 41, respectively, and the second hydraulic pump P2 supplies the oil to the first cavity 71 and the second cavity 71 under the control of a third control valve 42, respectively. The first hydraulic pump P1 and the second hydraulic pump P2 may be combined to supply the oil to the first cavity 71, and may also be combined to supply the oil to the second cavity 71.

Specifically, a pump outlet of the first hydraulic pump P1 is in communication with a first pumping oil path 31, and the first hydraulic pump P1 is in communication with the second control valve 41 through the first pumping oil path 31. The second control valve 41 is a three-position four-way valve, and the second control valve 41 has four oil ports, namely a pressure oil port p1, an oil return port t1, a working oil port a1, and a working oil port b1. The pump outlet of the first hydraulic pump P1 is in communication with the pressure oil port p1 through the first pumping oil path 31, the oil return port t1 is in communication with an oil return tank T, the working oil port a1 is in communication with the first working oil path 5, and the working oil port b1 is in communication with the second working oil path 6.

The second control valve 41 has a neutral position and two working positions. When the second control valve 41 is in the neutral position, none of the four oil ports is communicated. When the second control valve 41 is in a first working position (i.e. a right position in FIG. 1), the pressure oil port p1 is in communication with the working oil port a1, and the working oil port b1 is disconnected from the oil return port t1. When the second control valve 41 is in a second working position (i.e. a left position in FIG. 1), the pressure oil port p1 is in communication with the working oil port b1, and the working oil port a1 is in communication with the oil return port t1. When the second control valve 41 is in the first working position, the first hydraulic pump P1 may supply the oil to the first cavity 71. When the second control valve 41 is in the neutral position, the first hydraulic pump P1 does not supply the oil to the second cavity 71 and the first cavity 71. When the second control valve 41 is in the second working position, the first hydraulic pump P1 may supply the oil to the second cavity 71, and a hydraulic oil discharged from the first cavity 71 may return to the oil return tank T through the second control valve 41. The second control valve 41 may be a three-position four-way valve controlled by an electronic control, a hydraulic control, an electro-hydraulic control or another servo-motor control.

A pump outlet of the second hydraulic pump P2 is in communication with a second pumping oil path 32, and the second hydraulic pump P2 is in communication with the third control valve 42 through the second pumping oil passage 32. The third control valve 42 is a three-position four-way valve. The third control valve 42 has four oil ports, namely a pressure oil port p2, an oil return port t2, a working oil port a2, and a working oil port b2. The pump outlet of the second hydraulic pump P2 is in communication with the pressure oil port p2 through the second pumping oil path 32, the oil return port t2 is in communication with the oil return tank T, the working oil port a2 is in communication with the first working oil path 5, and the working oil port b2 is in communication with the second working oil path 6.

The third control valve 42 has a neutral position and two working positions. When the third control valve 42 is in the neutral position, none of the four ports is connected. When the third control valve 42 is in a first working position (i.e. a left position in FIG. 1), the pressure oil port p2 is in communication with the working oil port a2, and the working oil port b2 is disconnected from the oil return port t2. When the third control valve 42 is in a second working position (i.e. a right position in FIG. 1), the pressure oil port p2 is in communication with the working oil port b2, and the working oil port a2 is in communication with the oil return port t2. When the third control valve 42 is in the first working position, the second hydraulic pump P2 may supply the oil to the first cavity 71. When the third control valve 42 is in the neutral position, the second hydraulic pump P2 does not supply the oil to the second cavity 72 and the first cavity 71. When the third control valve 42 is in the second working position, the second hydraulic pump P2 may supply the oil to the second cavity 72, and the hydraulic oil discharged from the first cavity 71 may return to the oil return tank T through the third control valve 42. In some embodiments of the present disclosure, the third control valve 42 may be a three-position four-way valve controlled by an electronic control, a hydraulic control, an electro-hydraulic control or another servo-motor control.

By controlling the second control valve 41 and the third control valve 42 to be in the first working position, the first hydraulic pump P1 and the second hydraulic pump P2 may be combined to supply the oil to the first cavity 71 of the actuator 7. By controlling the second control valve 41 and the third control valve 42 to be in the second working position, the first hydraulic pump P1 and the second hydraulic pump P2 may be combined to supply the oil to the second cavity 72 of the actuator 7. At this time, the hydraulic oil discharged from the first cavity 71 may return to the oil return tank T through the second control valve 41 and the third control valve 42, so as to realize an oil return without a back pressure of the first cavity 71.

In some embodiments of the present disclosure, the first pumping oil path 31 is provided with a first one-way valve, and a pressure oil pumped by the first hydraulic pump P1 can only flow to the pressure oil port p1 unidirectionally through the first pumping oil path 31. The second pumping oil path 32 is provided with a second one-way valve, and a pressure oil pumped by the second hydraulic pump P2 can only flow to the pressure oil port p2 unidirectionally through the second pumping oil path 32.

The regeneration control hydraulic system of the embodiment further includes a regeneration oil path 1. The regeneration oil path 1 is configured to send a return oil to the first cavity 71 of the actuator 7 as a regeneration oil, and the return oil is the working oil discharged from the second cavity 72 of the actuator 7. The regeneration oil path 1 is provided with a regeneration valve 11 and a first control valve 12, and the regeneration valve 11 is configured to control a flow direction and an on-off of the regeneration oil in the regeneration oil path 1. The first control valve 12 is configured to control the regeneration oil to enter the first cavity 71 of the actuator 7 or to control the oil to be discharged from the first cavity 71 of the actuator 7 to a regeneration cut-off oil circuit 2.

In some embodiments of the present disclosure, both ends of the regeneration oil path 1 are in communication with the second working oil path 6 and the first working oil path 5, respectively. The regeneration valve 11 includes an on-off valve 111 and a third one-way valve 112. The on-off valve 111 may be a two-position two-way valve and is configured to control the on-off of the regeneration oil path 1. The third one-way valve 112 controls the direction of the regeneration oil path 1. The hydraulic oil in the second working oil path 6 may flow to the first working oil path 5 through the third one-way valve 112, but the hydraulic oil in the first working oil path 5 cannot flow to the second working oil path 6 through the third one-way valve 112. In some embodiments of the present disclosure, the on-off valve 111 and the third one-way valve 112 are arranged in series, and the on-off valve 111 is located upstream of the third one-way valve 112. In addition, the on-off valve 111 and the third one-way valve 112 may also be integrated, and the third one-way valve 112 is integrated to a valve core of the on-off valve 111.

In some embodiments of the present disclosure, the first control valve 12 is a logic valve, and the regeneration oil discharged from the second cavity 72 first passes through the regeneration valve 11 and then enters the first cavity 71 through the logic valve. When the oil is supplied to the second cavity 72, the oil discharged from the first cavity 71 may flow to the regeneration cut-off oil path 2 through the logic valve so as to be transported to other destinations. The opening pressure and control relationship of the logic valve may be further set, so as to realize a control without air suction of the outward swing of the bucket rod, thus improving the maneuverability and reliability of the action of the bucket rod.

The regeneration control hydraulic system of the embodiment further includes a regeneration cut-off oil path 2. The regeneration cut-off oil path 2 sends the regeneration oil passing through the regeneration valve 11 or the oil discharged from the first cavity 71 to other destinations, that is, the regeneration cut-off oil path 2 is in communication with the regeneration oil path 1 located between the regeneration valve 11 and the first control valve 12. When it is required to cut off the regeneration or adjust the amount of the regeneration oil, at least part of the regeneration oil discharged from the second cavity 72 may flow to the regeneration cut-off oil path 2 through the regeneration oil path 1 and the regeneration valve 11, so as to be sent to other destinations. When the bucket rod swings outwards, the logic valve may be opened, and the oil discharged from the first cavity 71 may flow to the regeneration cut-off oil path 2 through the logic valve, so as to be transported to other destinations.

Further, the regeneration cutoff oil path 2 is provided with a regeneration cut-off valve 21, and the regeneration cut-off valve 21 can control the on-off of the regeneration cut-off oil path 2. In some embodiments of the present disclosure, the regeneration cut-off valve 21 is a two-position two-way valve. In some embodiments of the present disclosure, the regeneration cut-off valve 21 is a valve that can be adjusted to have any opening. It is further provided that when the pressure in the first cavity 71 reaches a certain value, the regeneration cut-off valve 21 is opened, and the hydraulic oil discharged from the first cavity 71 can flow to the regeneration cut-off oil path 2 through the first control valve 12, so as to be sent to other destinations. Optionally, the other destinations may include, but are not limited to, the oil return tank T.

In some embodiments of the present disclosure, the on-off valve 111, the first control valve 12, and the fourth control valve 61 in the embodiment all may be valves controlled by an electronic control, a hydraulic control, an electro-hydraulic control or another servo-motor control.

In some embodiments of the present disclosure, the actuator 7 in the embodiment is a hydraulic pump, the first cavity 71 is a rodless cavity, and the second cavity 72 is a rod cavity. In addition, the actuator 7 may also be arranged reversely, the first cavity 71 is the rod cavity, and the second cavity 72 is the rodless cavity, as long as a working device can be driven to retract inwards and swing outwards.

Based on the above structure, the regeneration control hydraulic system of the embodiment may be configured to drive the bucket rod of the excavator to work. Taking driving the bucket rod as an example, the working principle of the regeneration control hydraulic system of the embodiment is described as follows.

In an initial state, the second control valve 41 and the third control valve 42 are both in the neutral position, and the two hydraulic pumps do not supply the oil to the actuator 7.

Figure 2:
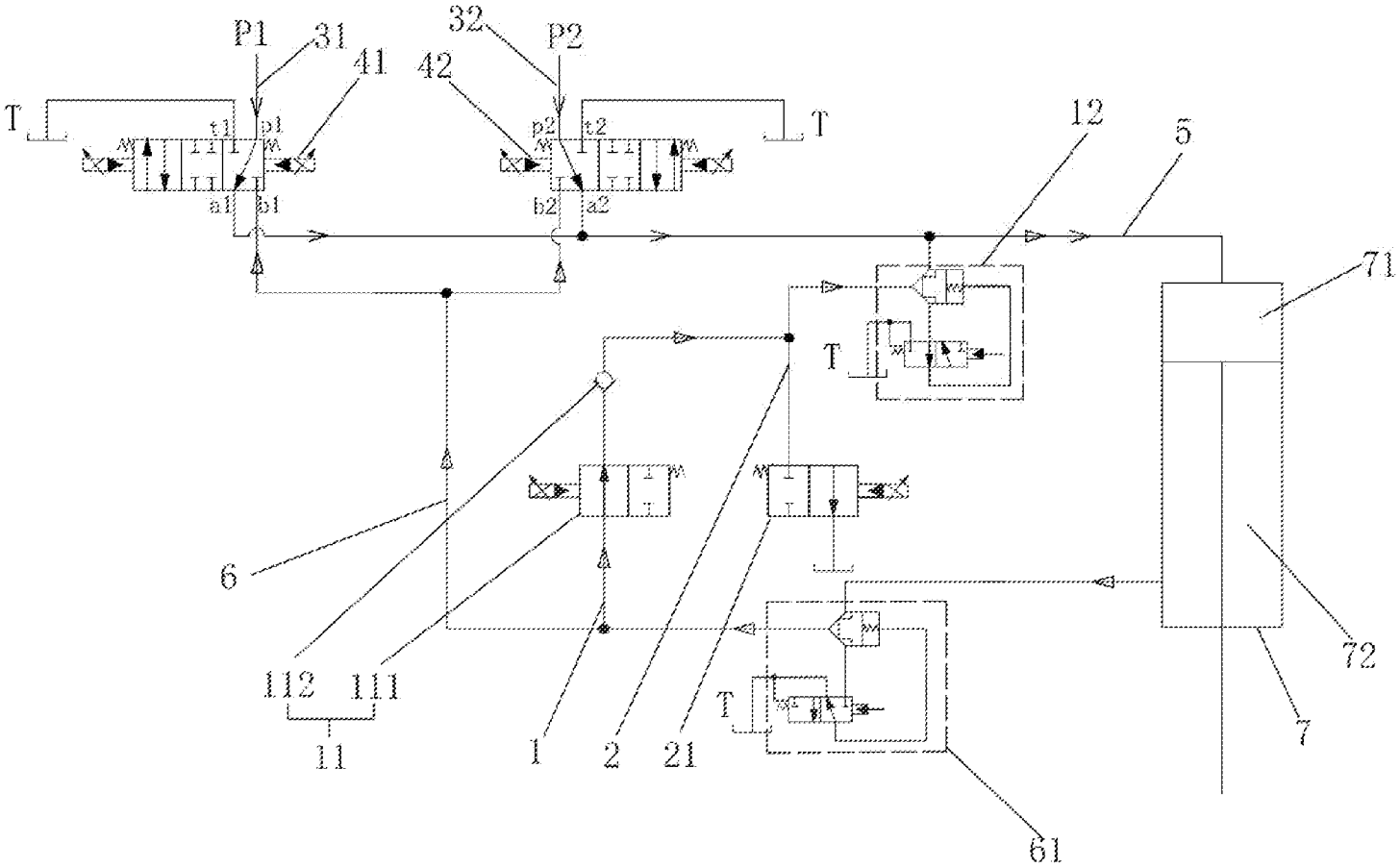
FIG. 2 is a view illustrating an oil path direction when a regeneration control hydraulic system supplies an oil to a first cavity with regeneration combination.

As illustrated in FIG. 2, in an earlier stage of retracting the bucket rod inwards, when the excavator does not perform an excavation work, the second control valve 41 and the third control valve 42 are both located in the first working position, and the first hydraulic pump P1 and the second hydraulic pump P1 are combined to pump the oil into the first cavity 71 through the first working oil path 5, and also the regeneration oil discharged from the second cavity 72 flows to the first working oil path 5 through the regeneration oil path 1, such that the regeneration oil and the oil pumped by the two hydraulic pumps are combined to be supplied to the first cavity 71. In this stage, the regeneration valve 11 in the regeneration oil path 1 is opened, and the regeneration cut-off valve 21 in the regeneration cut-off oil path 2 is closed. The regeneration oil flows through the regeneration valve 11 to push a valve core of the first control valve 12 to slide and open, such that the regeneration oil flows to the first working oil path 5, and the regeneration oil and the pumped oil are combined to be supplied to the first cavity 71. In this process, the oil flux of the regeneration oil regenerated to the first cavity 71 can also be controlled by adjusting the opening of the regeneration cut-off valve 21.

Figure 3:
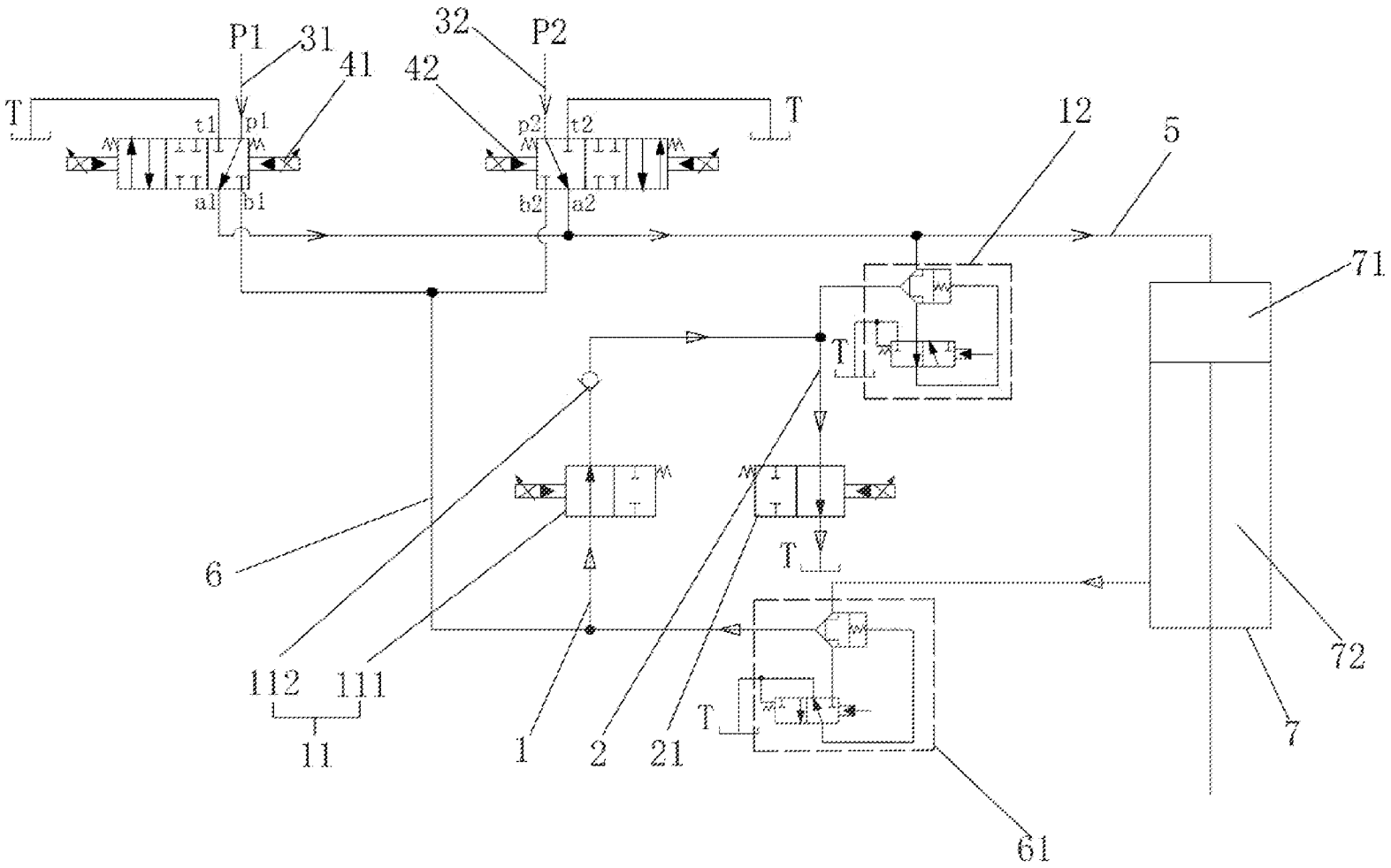
FIG. 3 is view of an oil path direction when a regeneration control hydraulic system supplies an oil to a first cavity with regeneration cut-off.

As illustrated in FIG. 3, in a later stage of retracting the bucket rod inwards, that is, when the bucket rod retracts inwards to be perpendicular to the ground, the second control valve 41 and the third control valve 42 are both located in the first working position, and the first hydraulic pump P1 and the second hydraulic pump P2 are combined to pump the oil into the first cavity 71 through the first working oil path 5, and also the regeneration valve 11 and the regeneration cut-off valve 21 are opened, and the regeneration oil discharged from the second cavity 72 flows to the regeneration cut-off oil path 2 through the regeneration oil path 1, so as to be transported to other destinations. The regeneration is cut off to reduce the pressure loss of the excavation of the bucket rod.

Figure 4:
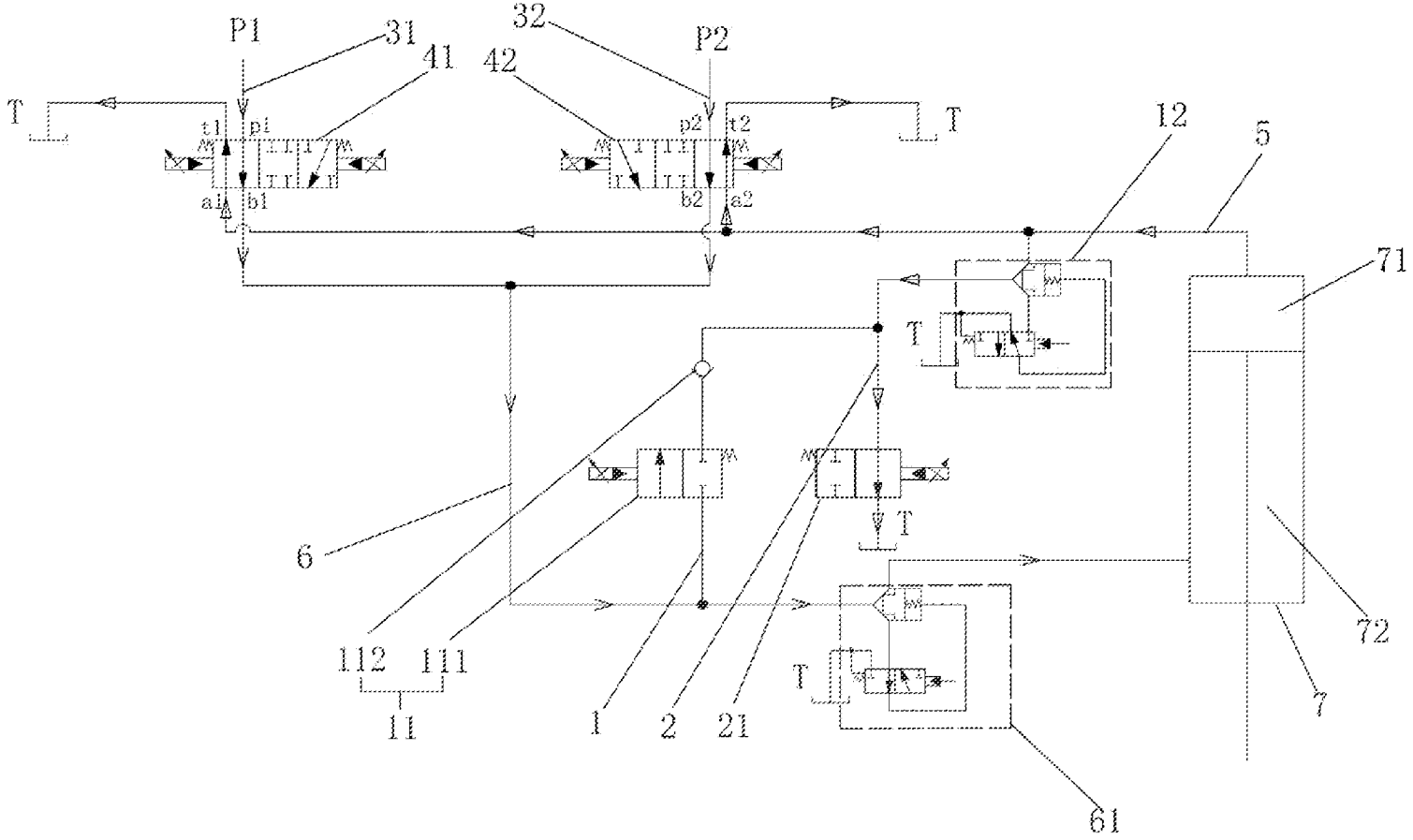
FIG. 4 is a view of an oil path direction when a regeneration control hydraulic system supplies an oil to a second cavity.

As illustrated in FIG. 4, in a process of the bucket rod swinging outwards, the second control valve 41 and the third control valve 42 are both in the second working position, and the first hydraulic pump P1 and the second hydraulic pump P2 are combined to pump the oil into the second cavity 72 through the second working oil path 6, that is, the oil enters in the second cavity 72. Moreover, a part of the hydraulic oil discharged from the first cavity 71 returns to the oil return tank T through the first working oil path 5 and the second control valve 41, and another of the hydraulic oil discharged from the first cavity 71 returns to the oil return tank T through the first working oil path 5 and the third control valve 42. In addition, the logic valve may also be configured to be opened when the bucket rod swings outwards. When the pressure in the first cavity 71 reaches a certain value, the regeneration cut-off valve 21 is opened, so that the hydraulic oil discharged from the first cavity 71 may also flow to the regeneration cut-off oil path 2 through the logic valve, and return to other destinations including the oil return tank T.

Reference throughout this specification to "an embodiment," "some embodiments," "an example," "a specific example," or "some examples." means that a particular feature, structure, material, or characteristic described in connection with the embodiment or example is included in at least one embodiment or example of the present disclosure. Thus, the appearances of the phrases such as "in some embodiments," "in one embodiment", "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples. In addition, those skilled in the related art may combine and incorporate different embodiments or examples and their features described in the specification, without mutual contradictions.

Although explanatory embodiments have been illustrated and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A regeneration control hydraulic system for an excavator, comprising:

at least one hydraulic pump configured to spray a working oil;

an actuator which configured to work by a supply of the working oil from the at least one hydraulic pump;

a regeneration oil path configured to send a return oil as a regeneration oil to a cavity having a negative pressure of the actuator, wherein the return oil is the working oil discharged from the actuator, the regeneration oil path is provided with a regeneration valve and a first control valve, and the first control valve is configured to control the regeneration oil to enter the cavity having the negative pressure of the actuator when a working device of the excavator retracts inwards; and a regeneration cut-off oil path, the first control valve being further configured to control the oil to be discharged from the actuator to the regeneration cut-off oil path when the working device of the excavator swings outwards, the regeneration cut-off oil path being configured to send the regeneration oil passing through the regeneration valve or the oil discharged from the actuator to other destinations, and the regeneration cut-off oil path being provided with a regeneration cut-off valve, wherein the hydraulic pump comprises a first hydraulic pump and a second hydraulic pump, a pump outlet of the first hydraulic pump is provided with a second control valve, a pump outlet of the second hydraulic pump is provided with a third control valve, the actuator has a first cavity and a second cavity, the first cavity is configured to serve as the cavity having the negative pressure, and the first hydraulic pump under the control of the second control valve and the second hydraulic pump under the control of the third control valve are configured to be combined to supply the oil to the first cavity and the second cavity of the actuator, respectively.

2. The regeneration control hydraulic system according to claim 1, wherein the first control valve is a logic valve.

3. The regeneration control hydraulic system according to claim 1, wherein the first cavity is in communication with a first working oil path, the second cavity is in communication with a second working oil path, the first hydraulic pump is configured to be in communication with the first working oil path and the second working oil path under the control of the second control valve, and the second hydraulic pump is configured to be in communication with the first working oil path and the second working oil path under the control of the third control valve.

4. The regeneration control hydraulic system according to claim 3, wherein the first hydraulic pump is respectively in communication with the first working oil path and the second working oil path under the control of the second control valve, and the second control valve comprises a pressure oil port in communication with the pump outlet of the first hydraulic pump, an oil return port in communication with an oil return tank, and two working oil ports in communication with the first working oil path and the second working oil path, respectively.

5. The regeneration control hydraulic system according to claim 3, wherein the second hydraulic pump is respectively in communication with the first working oil path and the second working oil path under the control of the third control valve, and the third control valve comprises a pressure oil port in communication with the pump outlet of the second hydraulic pump, an oil return port in communication with an oil return tank, and two working oil ports in communication with the first working oil path and the second working oil path, respectively.

6. The regeneration control hydraulic system according to claim 3, wherein the second control valve and the third control valve both have a neutral position, a first working position and a second working position, when the second control valve and the third control valve are both in the first working position, the first hydraulic pump and the second hydraulic pump are combined to supply the oil to the first cavity of the actuator, the working oil discharged from the second cavity is regenerated to the first cavity via the regeneration oil path or is transported to the other destinations via the regeneration cut-off oil path, when the second control valve and the third control valve are both in the second working position, the first hydraulic pump and the second hydraulic pump are combined to supply the oil to the second cavity, a hydraulic oil discharged from the first cavity is transported to the other destinations via the first control valve and the second control valve and/or the regeneration cut-off oil path.

7. The regeneration control hydraulic system according to claim 3, wherein both ends of the regeneration oil path are in communication with the first working oil path and the second working oil path, respectively.

8. The regeneration control hydraulic system according to claim 3, wherein the second working oil path is further provided with a fourth control valve, and the fourth control valve is configured to control the working oil pumped by the first hydraulic pump and the second hydraulic pump to enter the second cavity or to control the oil to be discharged from the second cavity to the regeneration oil path.

9. The regeneration control hydraulic system according to claim 8, wherein the fourth control valve is a holding valve.

* * * * *